United States Patent [19]

Rau et al.

[11] Patent Number: 4,925,054

[45] Date of Patent: May 15, 1990

[54] CARRYING ASSEMBLY WITH HANDGRIP FOR CONTAINERS, HOUSING AND THE LIKE

[75] Inventors: Georg Rau, Hohenmemmingen; Werner Hitzler, Herbrechtingen, both of Fed. Rep. of Germany

[73] Assignee: Firma Georg Knoblauch, Giengen, Fed. Rep. of Germany

[21] Appl. No.: 351,511

[22] Filed: May 12, 1989

[30] Foreign Application Priority Data

May 14, 1988 [DE] Fed. Rep. of Germany ..... 3816530

[51] Int. Cl.[5] ..... A45C 13/76

[52] U.S. Cl. ..... 220/94 R; 190/115

[58] Field of Search ..... 190/115; 220/94 R; 150/108

[56] References Cited

U.S. PATENT DOCUMENTS

| | | | |
|---|---|---|---|
| 337,367 | 3/1886 | Brockway | 190/115 |
| 1,047,941 | 12/1912 | Hollingsworth | 220/94 R |
| 1,958,587 | 5/1934 | Mitchell et al. | 190/115 |
| 2,745,524 | 5/1956 | Plotkin | 190/115 |
| 3,128,855 | 4/1964 | Hoffman et al. | 190/115 |
| 3,161,271 | 12/1964 | O'Neil | 190/115 |
| 3,566,436 | 3/1971 | Marks . | |
| 4,763,763 | 8/1988 | Sadow | 190/115 |

FOREIGN PATENT DOCUMENTS

| | | |
|---|---|---|
| 200669 | 3/1954 | Fed. Rep. of Germany . |
| 700784 | 6/1962 | Fed. Rep. of Germany . |

*Primary Examiner*—Joseph Man-Fu Moy

*Attorney, Agent, or Firm*—Herbert Dubno

[57] ABSTRACT

A grip for a container such as a tool box is provided by a strap having longitudinal slots at its end region by passing these end regions through guide strips formed unitary in the wall of the container so that projecting tongues formed unitary therein engage in the slots. This allows mounting without tools or damage to the housing in a simple manner.

7 Claims, 1 Drawing Sheet

CARRYING ASSEMBLY WITH HANDGRIP FOR CONTAINERS, HOUSING AND THE LIKE

FIELD OF THE INVENTION

My present invention relates to a carrying assembly for a container or a housing and especially a tool box or tool chest. More particularly, the invention relates to a carrying grip strap and the means for mounting same on such a container so that a central portion of the strap can be pulled away from the wall of the container to enable the hand of the user to engage around the strap and thereby utilize the strap as a grip for transporting the housing formed with the wall which can be sheet metal.

BACKGROUND OF THE INVENTION

It is known, of course, to provide a wide variety of hand grips for containers, housings, receptacles and like structures, which can be composed of sheet metal, and may be tool boxes or tool chests, where the carrying strap is held at its end regions on a wall of the container or housing and the mounting is such that the central region can be drawn slightly away from the wall to enable the fingers of a hand to pass therebeneath and utilize the strap as a grip.

In some constructions of this type, the strap, which can have a spring steel reinforcement or inlay, and which can be provided with a sheath of a plastic or other material can be attached to the container wall by bolts or rivets depending upon the thickness of the wall and the particular strap construction. The bolt or rivet can pass through a slot formed in the respective end region, which affords a certain mobility of the respective end region relative to the wall to accommodate the lifting of the central region away from the wall.

When the central region is pulled outwardly, the end of the slot remote from the central region engages the bolt or rivet to form a strap or abutment limiting further displacement of the end region.

For the mounting of the grip utilizing such bolts and rivets, a number of operations requiring tools and capable of damaging the finish of the wall, must be performed following the last steps in the fabrication of the container. Frequently, it is necessary, as a consequence, to repair the finish, e.g. by touching up the lacquer or by painting a portion of the wall. Hence, the strap mounting operation can be time consuming, labor intensive and costly.

OBJECTS OF THE INVENTION

It is, therefore, the principal object of the present invention to provide a carrying assembly for a container of the type described, which includes a flexible strap, whereby the aforementioned drawbacks are avoided.

Another object of this invention is to provide a carrying strap and mounting arrangement for that strap, such that the carrying strap can be mounted simply and rapidly and without the need for tools, and hence without any danger of damage to the finish of the tool box or like container.

SUMMARY OF THE INVENTION

These objects are attained, in accordance with the present invention by providing the wall of the container which is adapted to receive the carrying strap with at least one guide strip adapted to be traversed by a respective end region of the strap and which, in turn, is fixed at its ends with the wall and preferably is unitary therewith so that between the wall and the guide strip, a narrow gap of a width corresponding to the width of the respective strap end region and a height corresponding to the thickness of the respective end region of the strap with slight clearance, can be formed, through which the respective end of the strap can be slid in mounting of the strap.

To a side of the guide strap opposite that turned toward the central region of the strap, the wall is formed with a projection which likewise can be unitary with the wall and has a camming surface enabling that projection to be deflected by th leading end of the strap inserted through the gap defined by the guide strap so that the projection can then spring back into an elongated slot formed in the respective end region of the strap. Thus on the side of the projection facing the respective guide strap a camming surface or ramp is provided to allow the projection to be deflected toward the plane of the wall as the strap end is inserted through the gap, whereby the engagement of the projection, e.g. a tongue, in the slot will provide retention of the grip while allowing the limited liability thereof described previously.

Since the guide strap and the projecting tongues can be formed unitarily with the wall, they automatically receive the strap and mounting of the strap does not require the intervention of tools. Furthermore, the wall of the housing formed with the guide strips and tongues can be completely finished prior to insertion of the grip so that there is no danger of damage to the finish or refinishing steps therein required.

The invention has the advantage, therefore, that the carrying strap or grip can be mounted simply by inserting the ends through the respective guide strips so that these ends automatically have the respective tongues spring into the respective slots. Alternatively, the free end can be lifted by the respective tongues as they ride up the camming ramps formed by the tongues until the slots register with the tongues, whereupon the tongues engage in these slots.

Mounting of the grip is thus rapid and free from the intervention of any tools.

As noted, in a preferred construction of the invention, the guide strips are formed in one piece with the container wall, are defined by cutouts in the latter, and can be bent out of the plane of the container wall in a corrugation-like pattern. Thus the guide strips can be formed in a single stamping operation with a formation of the wall and the remainder of the container. The projections likewise can be formed at the same time as sheet metal flaps separated from the wall by being partially cutout therefrom and being bent outwardly so that the ramp surfaces of the tongues are inclined outwardly with respect to the central portion of the strap.

It has been found to be advantageous to provide for each end region of the strap, two guides strips, namely, the guide strips previously described and further guide strips which receive the leading ends of the two end regions and enclose these leading edges in all positions of the grip once the grip is mounted. The further guide strips allow the play required for the movement of the strap within the range defined by the respective elongated slots without liberating the leading end. Damage to the free ends of the strap during use is thus avoided since the free ends are entirely housed in the further guide strips. The further guide strips are preferably also formed in one piece with the wall by providing cutouts in the wall and pressing the further guide strips out of the plane of the latter.

The carrying assembly for a container of the housing, especially a tool box or tool chest, this can comprise:

a carrying grip strap having a central region and respective end regions at opposite extremities of the grip;

a wall provided with a pair of guide strips each attached to the wall at ends of the guide strips and extending transversely to the strap, the guide strips defining through going gaps with the wall, the end regions of the strap passing respectively through the gaps and being slidable therein whereby the central region can be pulled away from the wall to form a loop providing a handle;

respective slots formed in the end regions at sides of the guide strips turned away from the central region an elongated in a direction of movement of the end regions; and respective tongues projecting from the wall into the slots and forming camming ramps engageable by leading edges of the respective end regions as the end regions are inserted through the gaps to guide the free ends whereupon the tongues engage in the slots.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
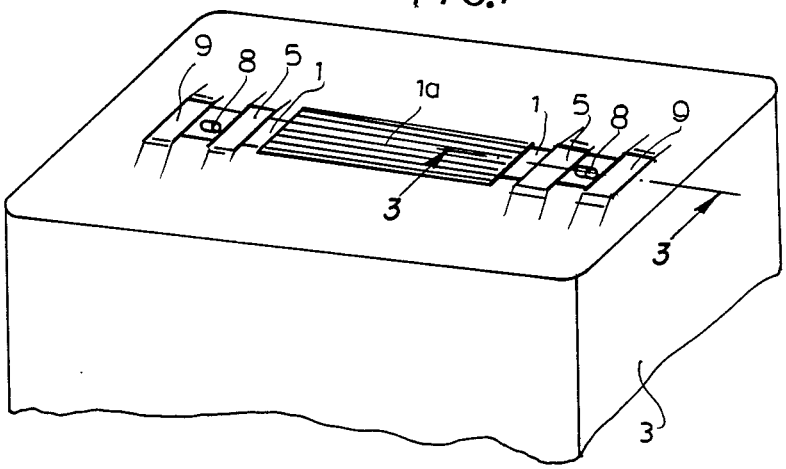
FIG. 1 is a perspective view of a carrying assembly as applied to a tool box highly diagrammatic but in accordance with the invention.

The carrying grip illustrated in the drawing can be used for containers and housings generally and specifically can be employed to great advantage for the carrying and handling of tool chests and tool boxes.

The grip assembly comprises a flexible strap 1 having end regions 2 which are respectively affixed to the container 3 and which are formed with elongated slots 4 extending in the longitudinal dimension of the carrying strap 1.

The slots 4 enable the strap 1 to lie against the container wall 3.1 in the rest position of the strap, but also enable the central region to be pulled away from the wall 3.1 to a slight extent so that a hand can be inserted between the wall and the central region 1*a* to grip the strap.

The end regions 2 are each engaged by and pass beneath guide strips 5 which, at each end 6, are fixed to the wall 3.1. As a consequence, throughgoing gaps 7 are provided between the guide strips 5 and the container wall 3.1.

The container wall 3.1 is formed with projections 8 which are spaced from the guide strips 5 away from the central region and engage in the respective slots 4 of the strap.

On their sides turned towards the guide strips 5 or facing the latter, the projections 8 are formed with camming ramps 8.1 along which the free ends of the strap can ride.

This construction enables a sample, rapid and tool-free mounting of the strap on the container 3 in that the free ends of the strap 1 are inserted through the respective guide strips 5 until the respective projections 8 engage in the respective longitudinal slots 4. During this action, the free ends of the strap 1 ride along the ramps 8.1 of the projection 8.

Figure 2:
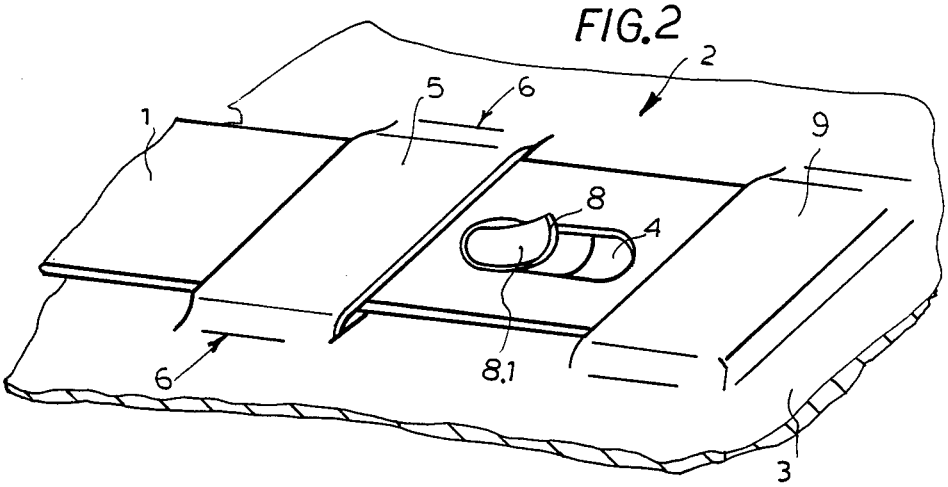
FIG. 2 is a detailed view of a portion of the assembly shown in FIG. 1.

Advantageously, the guide strips 5 are formed in one piece with the container wall 3.1 and the guide strips can be separated along their respective longitudinal edges from the wall and pressed or bent upwardly therefrom above the upper plane of the wall in a corrugation-like manner. In a similar way, the tongues 8 can be cut out or stamped from the sheet metal wall 3.1 and bent upwardly with an outward inclination as can be seen in FIGS. 2 and 3.

Further guide strips 9 can form pockets receiving the free end of the strap and retain to free ends of the strap independently from the position of the respective end region 2. The guide strips 9 provide additional guides for the end regions and protect the free ends of the strap, which generally are sharp edged, from damage while preventing injury to the user by contact with the free ends of the strap.

Figure 3:
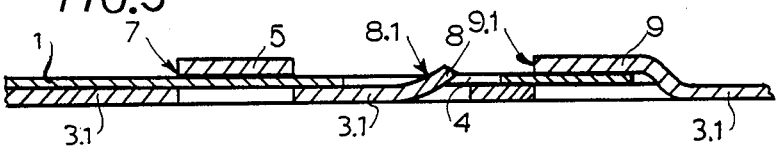
FIG. 3 is a cross sectional view of the mounting portion of the assembly taken along the line 3—III of FIG. 1.

These further guide strips 9 are likewise formed in one piece with the container wall 3.1 but are cut out from the latter only along 1 longitudinal edge so that they can provide the pocket as shown in FIG. 3.

I claim:

1. A carrying assembly for a container or a housing and especially a tool box or tool chest, comprising:

a carrying grip strap having a central region and respective end regions at opposite extremities of said grip;

a wall provided with a pair of guide strips each attached to said wall at ends of said guide strips and extending transversely to said strap, said guide strips defining throughgoing gaps with said wall, said end regions of said strap passing respectively through said gaps and being slidable therein whereby said central region can be pulled away from said wall to form a loop providing a handle;

respective slots formed in said end regions at sides of said guide strips turned away from said central region and elongated in a direction of movement of said end regions; and respective tongues projecting from said wall into said slots and forming camming ramps engageable by leading edges of the respective end regions as said end regions are inserted through said gaps to guide said free ends whereupon said tongues engage in said slots.

2. The assembly defined in claim 1 wherein said guide strips are formed in one piece with said wall, are defined by a respective cutout formed in the wall, and are bent corrugation-like out of a plane of the wall.

3. The assembly defined in claim 1 wherein said tongues are flaps formed in one piece with the wall and are cut out from the wall and bent from said wall toward said strap and outwardly to project from a surface against which said strap can lie.

4. The assembly defined in claim 1 wherein said wall is formed with further guide strips engaging the respective end regions of said strap at said leading edges and at an opposite side of the respective slot from the first-mentioned guide strip engaging the respective end region independently of the position of the end region in the first-mentioned guide strip.

5. The assembly defined in claim 4 wherein said further guide strips are formed in one piece with said wall, are defined by a respective cutout formed in the wall, and are bent corrugation-like out of a plane of the wall.

6. The assembly defined in claim 4 wherein said tongues are flaps formed in one piece with the wall and are cut out from the wall and bent from said wall toward said strap and outwardly to project from a surface against which said strap can lie.

7. The assembly defined in claim 6 wherein said guide strips are formed in one piece with said wall, are defined by a respective cutout formed in the wall, and are bent corrugation-like out of a plane of the wall.

* * * * *